US006551138B2

(12) United States Patent
Ruque

(10) Patent No.: US 6,551,138 B2
(45) Date of Patent: Apr. 22, 2003

(54) PROTECTION DEVICE FOR PROTECTING A PCB ELECTRICAL CONNECTOR FROM ELECTROMAGNETIC INTERFERENCE

(75) Inventor: Christian Ruque, Corbas (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/981,899

(22) Filed: Oct. 19, 2001

(65) Prior Publication Data

US 2002/0052144 A1 May 2, 2002

(30) Foreign Application Priority Data

Oct. 23, 2000 (FR) ..... 00 13561

(51) Int. Cl.[7] ..... H01R 13/648
(52) U.S. Cl. ..... 439/607; 439/108; 439/377
(58) Field of Search ..... 439/607–609, 439/108, 95, 377, 64

(56) References Cited

U.S. PATENT DOCUMENTS 5,141,445 A * 8/1992 Little ..... 439/108
5,295,867 A * 3/1994 Bethurum ..... 439/108
5,316,501 A 5/1994 Mair
5,356,301 A * 10/1994 Champion et al. ..... 439/609
5,500,788 A * 3/1996 Longueville et al. ..... 439/609
5,564,948 A * 10/1996 Harting et al. ..... 439/607
5,967,806 A 10/1999 Patterson
6,008,995 A * 12/1999 Pusateri et al. ..... 439/377
6,019,616 A * 2/2000 Yagi et al. ..... 439/108
6,305,983 B1 * 10/2001 Harting et al. ..... 439/607

FOREIGN PATENT DOCUMENTS

EP 0 422 785 4/1991
EP 0 891 017 1/1999

* cited by examiner

*Primary Examiner*—Renee Luebke
*Assistant Examiner*—Felix O. Figueroa
(74) *Attorney, Agent, or Firm*—Sughrue Mion, PLLC

(57) ABSTRACT

A device for protecting an electrical connector for a printed circuit board from electromagnetic interference, the connector including a body having a front face to co-operate with a plug and a connection side face touching the board, and contacts, ending in spikes, the spikes being inserted through holes in the board to electrically connect the contacts to conductor tracks; the device including a first shielding element extending along a side face opposite from the connection side face, and continuing along a rear face so as to contact a grounding conductor track; and a second shielding element mounted on a face of the board opposite from the face of the board contacting the connector, and extending along the connection side face, the second shielding element contacting a conductor track, connected to the grounding track, so as to be electrically connected to the first shielding element thus forming a potential cage.

5 Claims, 6 Drawing Sheets

PROTECTION DEVICE FOR PROTECTING A PCB ELECTRICAL CONNECTOR FROM ELECTROMAGNETIC INTERFERENCE

The present invention relates to a protection device for protecting an electrical connector from electromagnetic interference, the connector including a body made of a plastics material having a front face serving to co-operate with a removable plug and a connection side face touching a printed circuit board.

The device of the invention may be used in particular for protecting from electromagnetic interference a connector of known type such as DIN Standard F48 or E48 connectors which are in common use for interconnecting printed circuits with control or power supply cables, e.g. in an installation having electronics cards carried by a rack module on board a motive power unit of a rail vehicle.

BACKGROUND OF THE INVENTION

In the prior art, in particular in compliance with Standard Deutsches Insitut für Normung eV (DIN) 41612/International Electrotechnical Commission (IEC) 603-2 and using DIN F48 or E48 type connectors, it is known that is possible to protect electronics cards from electromagnetic radiation by using removable plugs that are shielded by means of conductive cladding of the "Zamak" type. Unfortunately, such a solution suffers from the drawback of significantly increasing the overall size of the plug, which makes it necessary to reduce the number of contacts available in the plug for cards at the same pitch. In addition, such a shielded plug is much more costly to manufacture than a conventional plug made of plastic, and it is much heavier, which gives rise to additional constraints, in particular in terms of vibration behavior. Another drawback with shielded plugs is that the magnetic protection disappears whenever the plug is removed, even though, in some uses, a plug is necessarily plugged in only occasionally, in particular for maintenance or testing of certain electronics cards. Such a solution makes it necessary to leave a shielded plug connected permanently in order to guarantee that the electronics card is magnetically protected, which gives rise to increased equipment cost.

OBJECTS AND SUMMARY OF THE INVENTION

An object of the present invention is thus to remedy the various above-mentioned drawbacks of the prior art.

To this end, the invention provides a protection device for protecting an electrical connector for a printed circuit board from electromagnetic interference, the connector including a body made of a plastics material having a front face serving to co-operate with a removable plug and a connection side face touching the board of the printed circuit, the connector including a plurality of contacts, each of which has one end in the form of a spike that projects from the connection side face, the spikes being inserted through holes in the board for the purpose of electrically connecting the contacts to one or more conductor tracks of the printed circuit, said protection device comprising a first shielding element extending facing the side face of the connector that is opposite from the connection side face, and continuing facing the rear face of the connector so as to come into contact with a grounding conductor track of the board of the printed circuit, and a second shielding element mounted on that face of the board of the printed circuit which is opposite from its face in contact with the connector, and extending facing said connection side face, the second shielding element being in contact with a conductor track connected to the grounding track of the printed circuit so as to be electrically connected to the first shielding element and so as to form a potential cage.

In particular embodiments, the protection device of the invention may comprise one or more of the following characteristics, taken either in isolation or in any technically feasible combination:

- the first shielding element comprises a metal element that is substantially uninterrupted and that extends facing the rear face of the connector to the vicinity of the board of the printed circuit, that edge of the metal element which is adjacent to the printed circuit board being provided with spikes that are inserted into plated through holes in the board of the printed circuit, which holes are in contact with the grounding track of the printed circuit.
- the first shielding element is constituted by a metal angle bracket having a branch extending facing that side face of the connector which is opposite from the connection face, and a branch extending facing the rear face of the connector;
- the connector includes a plurality of rows of contacts including a top row of contacts that is the row furthest from the board of the printed circuit and that has a rear portion extending perpendicularly to the board of the printed circuit at the rear face of the connector so that the ends of the contacts, which ends are in the form of spikes, penetrate into plated through holes in the board, the top row of contacts being used to form a first shielding element by connecting the spikes of the contacts of the top row to the grounding conductor track;
- the first shielding element is formed by a metal sheet co-operating with the top row of contacts, said metal sheet extending facing that side face of the connector which is opposite from the connection face, and having a curved-over end coming into contact with said top row of contacts;
- the second shielding element is constituted by a metal sheet which is in contact with a track disposed at the surface of the board and connected to the grounding track to which the spikes of the first shielding element are connected;
- the printed circuit board is designed to equip a rack module provided with many electronics cards disposed side-by-side, the metal sheet that constitutes the second shielding element being provided with resilient tongues projecting sideways from the fascia element so as to establish electrical contact with the shielding elements of a connector carried by an adjoining electronics card that is held in the rack module;
- a fascia element is mounted on said connector, said fascia element being provided with fixing means for mounting the printed circuit on a rack module;
- the fascia element supports the metal elements of the first shielding element;
- the connector complies with DIN Standard type F48;
- the fascia element includes an electrically-conductive body surrounding all four side faces of the connector, the fascia element including a top wall adjacent to that side wall of the connector which is opposite from its connection face, and a bottom wall adjacent to the board of the printed circuit, the walls respectively participating in forming the first and second shielding elements;

the first shielding element is formed by the top wall and by a metal angle bracket mounted against the top wall, said angle bracket having a branch extending facing the rear face of the connector and being fixed to the top wall so that electrical continuity exists between the angle bracket and the top wall;

the first shielding element is formed by the top wall and by a metal sheet mounted against the top wall, the metal sheet co-operating with the top row of contacts and having a curved-over end coming into contact with said top row of contacts;

the second shielding element is formed by the bottom wall which is in contact with a conductor track disposed at the surface of the board of the printed circuit and connected to the grounding track to which the spikes of the first shielding element are connected;

the printed circuit board is designed to equip a rack module provided with many electronics cards disposed side-by-side, and the bottom wall of the fascia element is provided with resilient tongues that project sideways from the fascia element so as to establish electrical contact with the shielding elements of a connector carried by an adjoining electronics card that is held in said rack module;

the fascia element is a "Zamak" casting, and the connector complies with DIN Standard type E48.

BRIEF DESCRIPTION OF THE DRAWINGS

The objects, features, and advantages of the present invention are better understood from the following description of embodiments and variant embodiments of the invention given by way of non-limiting example and with reference to the accompanying drawings, in which.

MORE DETAILED DESCRIPTION

To facilitate understanding the drawings, only those elements which are necessary to understanding the invention are shown.

Figure 1:
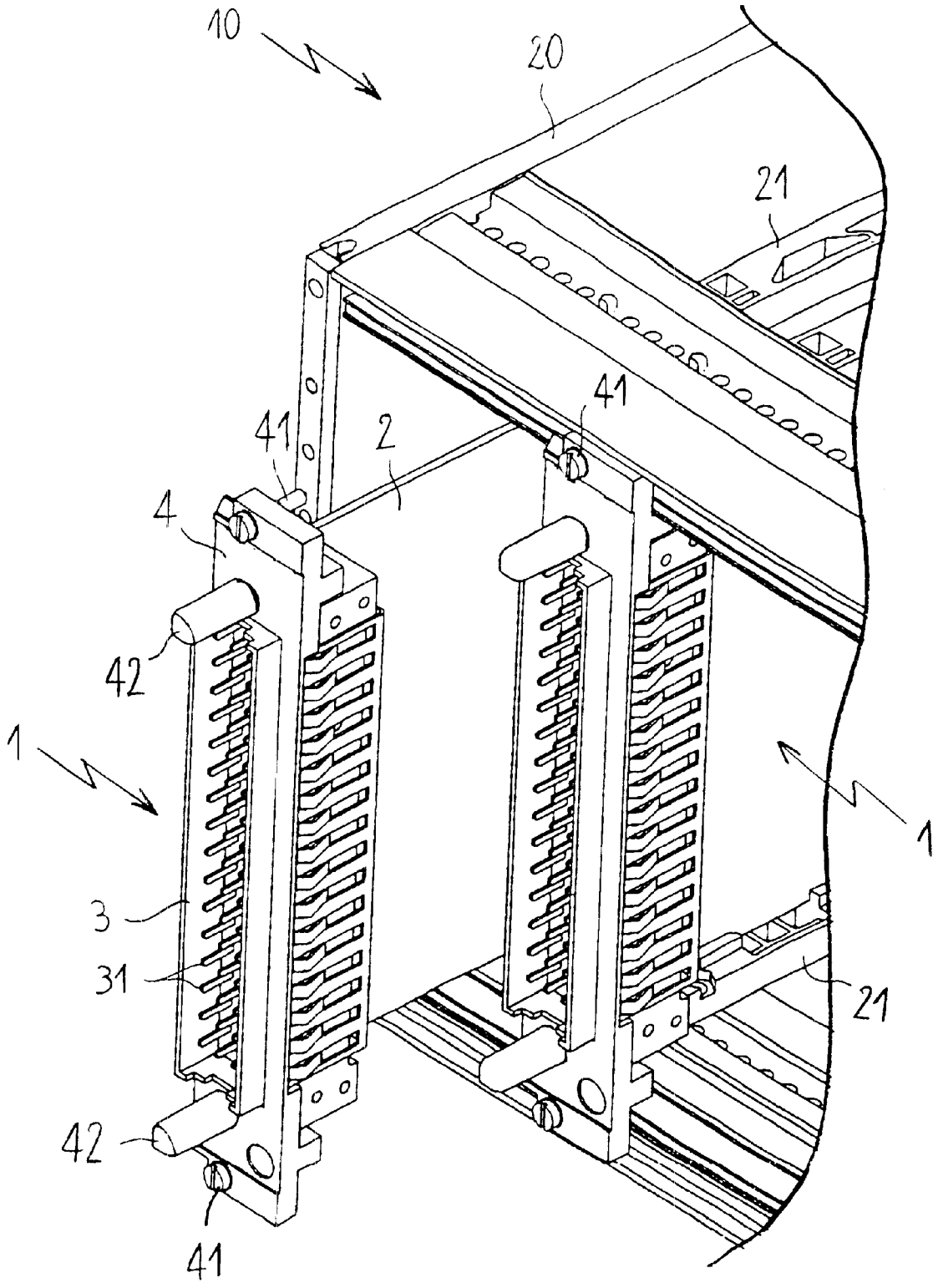
FIG. 1 is a perspective view of the front face of a rack module supporting a plurality of electronics cards, each of which comprises a printed circuit board provided with a DIN F 48 type connector equipped with a first embodiment of a protection device of the invention.
Figure 2:
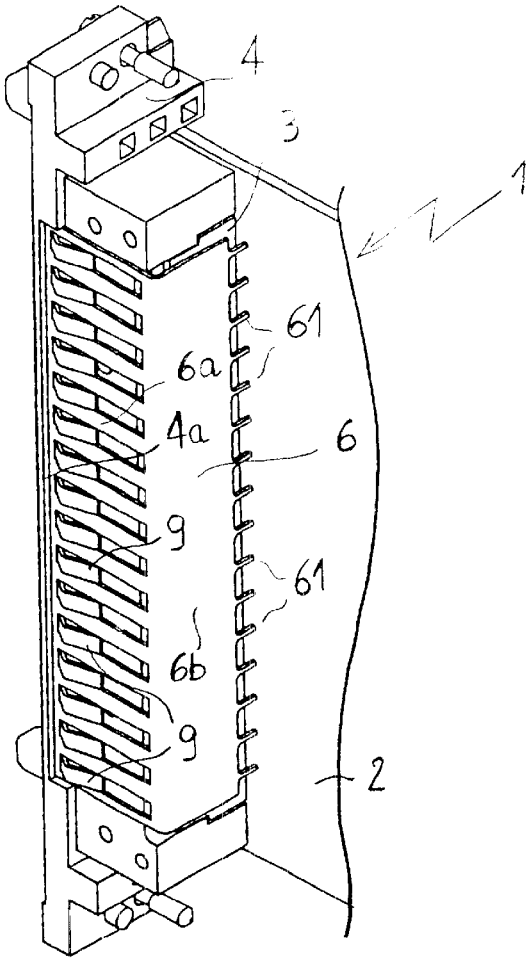
FIG. 2 is a three-quarters rear perspective detail view of the connector of a printed circuit board of FIG. 1.

FIG. 1 shows a rack module 10 of the type described in the Applicant's Application FR 99 10 097, supporting a plurality of electronics cards 1 in an installation on board a rail vehicle. The rack module 10 comprises a frame 20 provided with metal walls to which guide rails 21 are fixed. The guide rails make it possible to insert the electronics cards 1 via the front face of the frame 20. Each electronics card 1 comprises a printed circuit board 2 whose front edge is provided with a connector 3 and with a fascia element 4 surrounding the connector 3 so as to close off the front face of the frame 20. The boards 2 of the printed circuits support electronics components (not shown) and their rear ends support second connectors (not shown) that connect automatically to link cables at the end of the insertion stroke whereby the electronics cards are inserted into the guide rails 21.

As shown in FIG. 1, the fascia element 4 is provided with fixing screws 41 that hold the electronics card 1 stationary in the frame 20. The fascia element 4 also has a front face provided with studs 42 serving to co-operate with guide orifices in a plug (not shown) so as to guide said plug as it is being inserted into the connector. The fascia element 4 is preferably a "Zamak" casting so as to be electrically conductive, it being possible to improve its conductivity by means of surface treatment comprising nickel deposition. In a variant embodiment, suitable for environments that are not very severe, the fascia element 4 may also be made of a molded plastics material and metal-plated with nickel.

As shown in FIGS. 1 to 4, the connector 3 comprises a body made of a plastics material and in compliance with DIN 41612/IEC 603-2 Standard of the F48 type, and having a front face provided with three mutually-parallel rows of sixteen connection pins 31. The pins 31 are embedded in the body molding of the connector 3, and each of them has a rear portion with a bend in it and whose end is in the form of a spike 31 that projects from a connection side face 3*c* of the connector 3. The connection side face 3*c* is provided with a setback for receiving the printed circuit board 2 on the connector 3, without increasing the overall width of the connector.

The connector 3 bears via its connector face 3*c* against the board 2 of the printed circuit so that the spikes 31*a* penetrate through plated through holes in the printed circuit so that they project slightly from the other face of the printed circuit, and the spikes 31*a* are soldered to establish electrical contact between the pins 31 and conductor tracks (not shown) on the printed circuit.

The fascia element 4 has a channel-section body that surrounds the three side faces of the connector 3 that do not bear against the printed circuit board 2, the front face of the fascia element 4 being mounted slightly set back from the front edge of the connector 3.

The central portion 4*a* of the body of the fascia element 4 is parallel to the printed circuit board 2, and, on its outside face, it supports a first shielding element 6 constituted by a metal angle bracket 6*a* of which one branch 6*a* extends parallel to the printed circuit board, facing and in the vicinity of the side face 3*a* of the connector that is opposite from the connection side face 3*c*, and the other branch 6*b* extends along the rear face 3*b* of the connector 3, perpendicularly to and to the vicinity of the printed circuit-board 2. The branch 6*a* parallel to the printed circuit extends from the front edge of the fascia element 4 to the rear edge of the connector 3, and is directly in contact with the fascia element 4 so that electrical continuity exists between the angle bracket 6 and the fascia element 4. The branch 6*b* extending along the rear face 3*b* of the connector 3 is uninterrupted, and the edge of the branch 6*b* adjacent to the board 2 is provided with spikes 61 which are inserted through the plated through holes in the printed circuit board that are connected to a grounding conductor track. The branch 6*a* parallel to the printed circuit is substantially uninterrupted and it is provided with resilient tongues 9 which are advantageously formed by cutting out and folding, and which project from one side of the fascia element 4 to establish contact with a shielding element of an adjoining card disposed in the rack module 10, as shown in FIG. 4.

Figure 3:
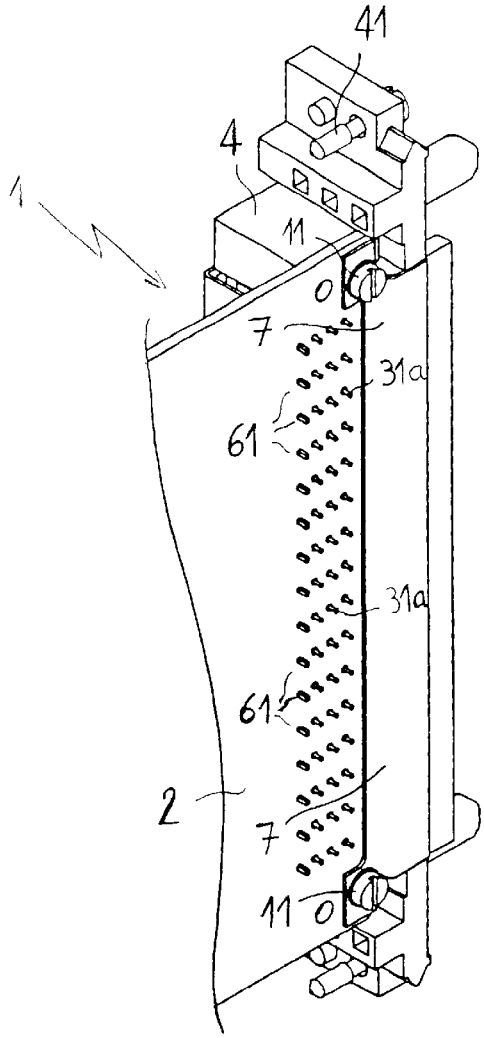
FIG. 3 is a view symmetrical to FIG. 2 about the plane of the printed circuit board.
Figure 4:
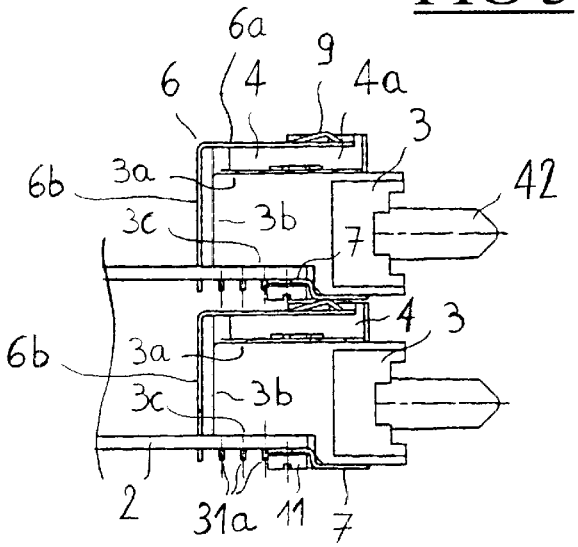
FIG. 4 is a side detail view of the two electronics cards of FIG. 1 as mounted so that they are adjoining.

As shown in FIGS. 3 and 4, the face of the printed circuit board that is opposite from its face in contact with the connector 3 is covered with a second shielding element 7 constituted by metal sheet extending facing the connection side face 3*c* of the connector. The metal sheet 7 is in contact with a conductor track (not shown) coming up to the surface of the integrated circuit board at this point, and connected to the grounding conductor track to which the spikes 61 of the first shielding sheet 6 are connected, thereby providing electrical conductivity between the first shielding element 6 and the second shielding element 7.

The metal sheet 7 forming the second shielding element has a fitted rear shape that goes round the zones from which the spikes 31*a* of the pins 31 project, and has a step that matches the setback formed by the junction where the front edge of the board 2 meets the connector 3, so as to cover the front portion of the connection side face 3*c* of the connector 3 up to the front face of the fascia element 4.

The shielding metal sheet 7 is held in abutment against the board 2 of the printed circuit by means of two fixing screws 11 screwed to the fascia element 4 and sandwiching the connector 3, the printed circuit board 2, and the metal sheet 7.

The resulting protection device forms a potential cage surrounding the connection face, the opposite face, and the rear face of the connector, thereby protecting the electronic components carried by the printed circuit board from electromagnetic interference passing through the front face of the connector. In addition, since the fascia element surrounding the front face of the connector is made of a conductive material and electrically connected to the shielding elements of the connector, the set of electronics cards placed touching one another forms a potential barrier limiting the amount of electromagnetic interference that can enter via the front face of the rack module, thereby protecting all of the electromagnetic components carried by the electronics cards.

Figure 5:
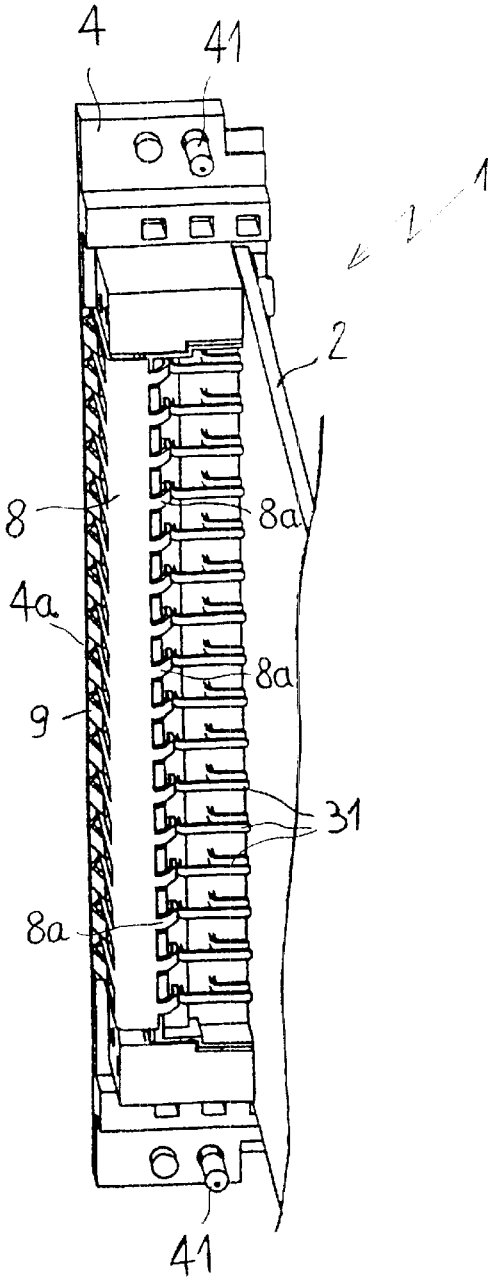
FIG. 5 is a rear perspective view of a variant embodiment of the protection device of FIG. 2.
Figure 6:
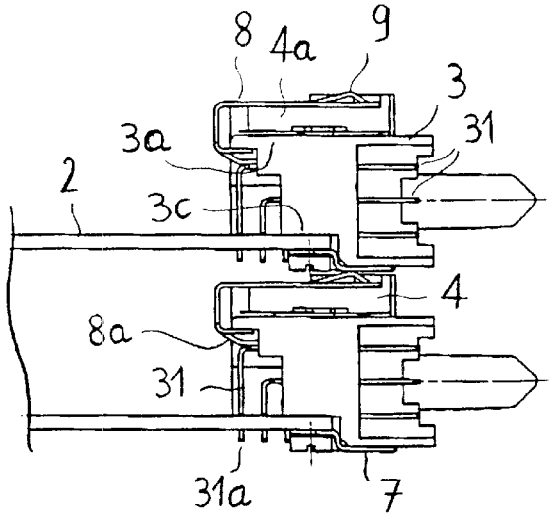
FIG. 6 is a view similar to FIG. 4 of the variant embodiment of FIG. 5.
Figure 7:
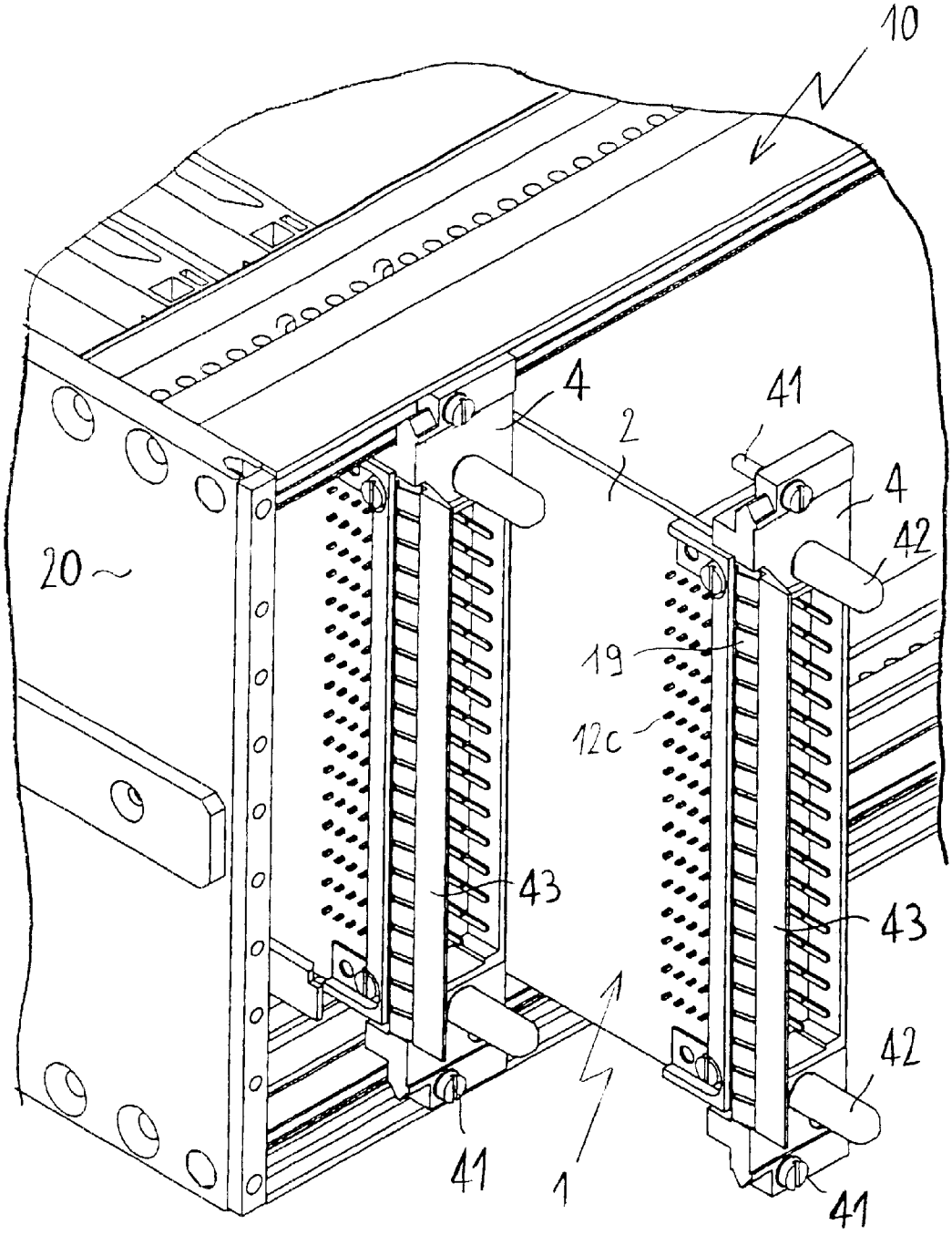
FIG. 7 is a perspective view of a rack module supporting a plurality of electronics cards, each of which comprises a printed circuit board provided with a DIN E 48 type connector equipped with another embodiment of a protection device of the invention.
Figure 8:
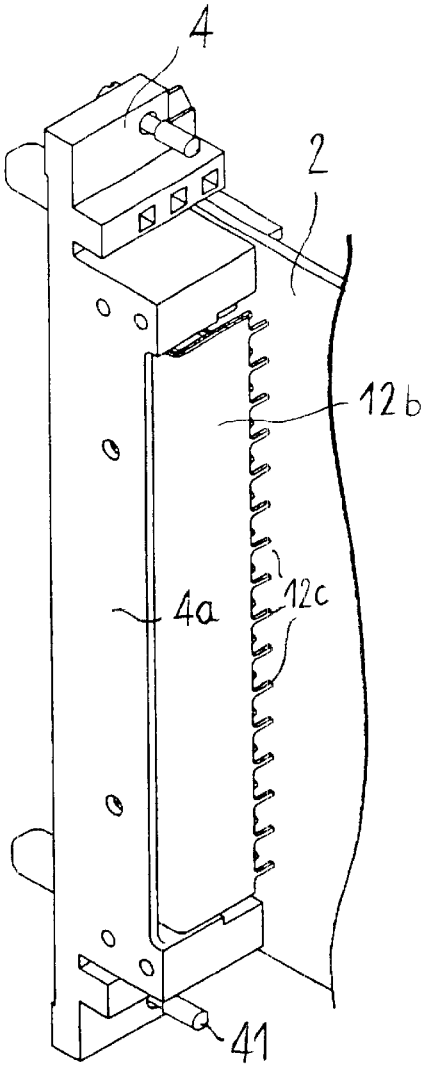
FIG. 8 is a three-quarters rear perspective detail view of the connector of a printed circuit board of FIG. 7.

FIGS. 5 and 6 show a variant embodiment of the protection device for protecting the electrical connector described with reference to FIGS. 1 to 4. In this variant embodiment, the first shielding element and the grounding conductor track of the printed circuit are implemented differently, while the other elements remain identical to what is described above. As shown in FIG. 5, the central portion 4*a* of the channel-section body of the fascia element (identical to the fascia element of FIGS. 1 to 4) supports a shielding metal sheet 8 that is substantially uninterrupted and that extends facing that side face 3*a* of the connector 3 which is opposite from the connection side face 3*c*. The metal sheet 8 is provided with a curved-over end matching the shape of the rear edge of the fascia element 4 and provided with tabs 8*a* coming into abutment against the top row of the pins 31 of the connector 3, i.e. the row that is furthest from the board 2 of the printed circuit. This top row of the pins 31 of the connector extends parallel to the board 2 from the front face of the connector 3 to the vicinity of the rear face of the connector 3, and then extends perpendicular to the board 2 of the printed circuit at the rear face of the connector 3 so that the ends of the pins 31 that form the spikes 31*a* penetrate through the plated through holes in the board 2 and come into contact with a grounding conductor track of the printed circuit.

The shielding metal sheet 8 is further provided with resilient tongues 9 projecting from one side of the fascia element 4 so as to establish contact with a shielding element of an adjoining card disposed in the rack module, as shown in FIG. 6.

The printed circuit board supports a second shielding element 7 identical to the element described in FIGS. 1 to 4, and disposed in contact with a conductor track connected to the grounding conductor track to which the end spikes 31*a* of the top row of pins 31 are connected.

In this variant embodiment, the top row of pins is used to implement the first shielding element, in association with the metal sheet supported by the top portion of the fascia element. The shielding of the rear face of the connector is then implemented by the mesh formed by the succession of pins extending perpendicularly to the printed circuit board and connected to the grounding circuit. Such a variant embodiment is possible when the top row of pins can be made available for the shielding, i.e. when the number of pins necessary for transmitting information through the connector is much lower than the number of pins available on the connector. Such a variant offers the advantage of being simple to implement by requiring few holes and few conductor tracks on the printed circuit board. The higher the number of pins used for the shielding and the closer they are together, the higher the performance at high frequencies of the protection from electromagnetic interference that is procured by this variant embodiment. Naturally, it is possible, in other variant embodiments (not shown) of the protection device of the invention to use fewer pins for the shielding so as to have more pins available for information transmission.

FIGS. 7 to 10 show a second embodiment of the protection device of the invention, in which the connector 3 used on the front face of the electronics card 1 complies with Standard DIN E 48.

Similarly to the connector of the first embodiment described above, the DIN E 48 Standard connector 3 has a body made of a plastics material and having a front face provided with three mutually-parallel rows of sixteen pins 31, only the spacing between the pins 31 being greater than the spacing between the pins in DIN F 48 Standard connectors.

The connector 3 is touching the printed circuit board 2 via its connection side face 3*c*, and the end spikes 31*a* of the pins 31 penetrate into plated through holes (not shown) and are soldered to provide electrical contact between the pins 31*a* and conductor tracks (not shown) on the printed circuit board 2.

A fascia element 4 having a substantially rectangular body is mounted around the electronics card 1 constituted by the connector 3 and by the printed circuit board 2. The body of the fascia element 4 has a fitted opening making it possible to put the fascia element 4 in place over the assembly comprising the connector 3 and the board 2, so that the front face of the fascia element 4 is substantially flush with the front edge of the connector. The fascia element 4 is made by molding an electrically-conducive material, such as "Zamak", and it has a front face provided with two studs 42 serving to co-operate with guide orifices in a plug (not shown) to guide said plug as it is being inserted into the connector 3. The front face of the fascia element 4 is also provided with two fixing screws 41 for holding the electronics card 1 stationary on the frame 20, and, in alignment with the printed circuit board 2, it is provided with a guide edging strip 43 projecting frontwards.

The body of the fascia element 4 is provided with a top wall 4*a* adjacent to the side face 3*a* of the connector 3, and extending parallel to the printed circuit board 2 to co-operate with a metal angle bracket 12 mounted against the top wall 4*a* to constitute a first shielding element. The angle bracket 12 has an uninterrupted branch 12*a* that extends parallel to the printed circuit board 2 over the rear portion of the fascia element while being held in contact with the bottom face of the top wall 4*a* by two screws so that electrical continuity exists between the angle bracket 12 and the fascia element 4. The angle bracket 12 also includes an uninterrupted branch 12*b* that extends along the rear face 3*b* of the connector 3, perpendicularly to and to the vicinity of the printed circuit board 2, and having an edge adjacent to the printed circuit board 2 that is provided with spikes 12*c* which are inserted through plated through holes in the board 2 and are connected to a grounding conductor track.

Figure 9:
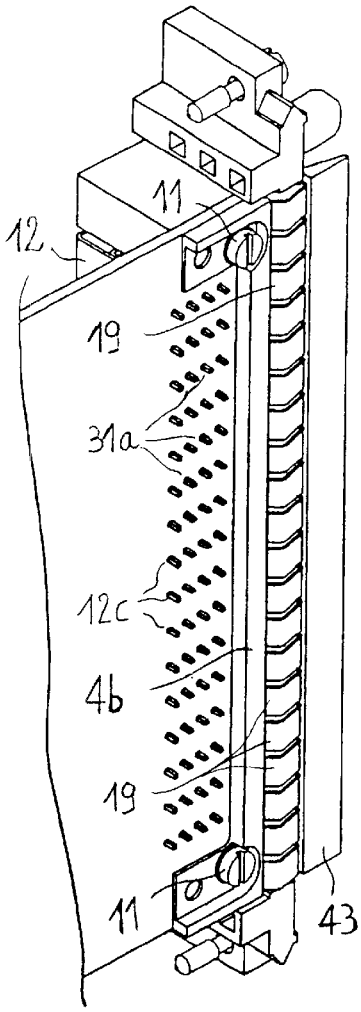
FIG. 9 is a view symmetrical to FIG. 8 about the plane of the board of the printed circuit.
Figure 10:
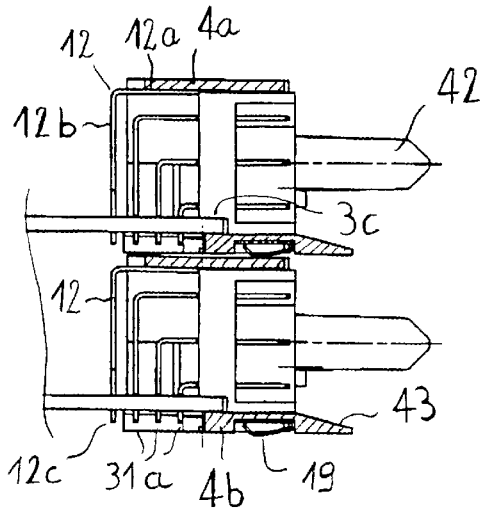
FIG. 10 is a side detail view of the two electronics cards of FIG. 7 as mounted so that they are adjoining.

As shown in FIGS. 9 and 10, the body of the fascia element 4 includes a bottom wall 4*b* which is in contact with the printed circuit board 2, and which extends facing the connection side face 3*c* of the connector 3 so as to constitute a second shielding element. The bottom wall 4*b*, adjacent to the printed circuit board 2, has a fitted rear shape that goes round the zone from which the spikes 31*a* of the pins 31 project, and that covers the front portion of the printed circuit board 2 by coming into contact with a conductor track (not shown) which comes to the surface of the printed circuit board 2 and which is connected to the grounding conductor track to which the spikes 12*c* of the shielding sheet 12 are connected.

The printed circuit board 2 is held in contact with the bottom wall 4*b* by means of two fixing screws 11 screwed to the connector 3 while sandwiching the printed circuit board 2. The outside face of the bottom wall 4*b* is provided with a groove that receives a metal strip provided with resilient tongues 19 projecting sideways from the side face of the fascia element 4 so as to establish contact with a shielding element of an adjoining card, as shown in FIG. 10.

With the assembly formed by the fascia element assembled to the electronics card taking up a limited amount of space laterally, such an embodiment makes it possible to provide excellent protection for the electronics components carried by the printed circuit board from electromagnetic interference passing through the front face of the connector.

Figure 11:
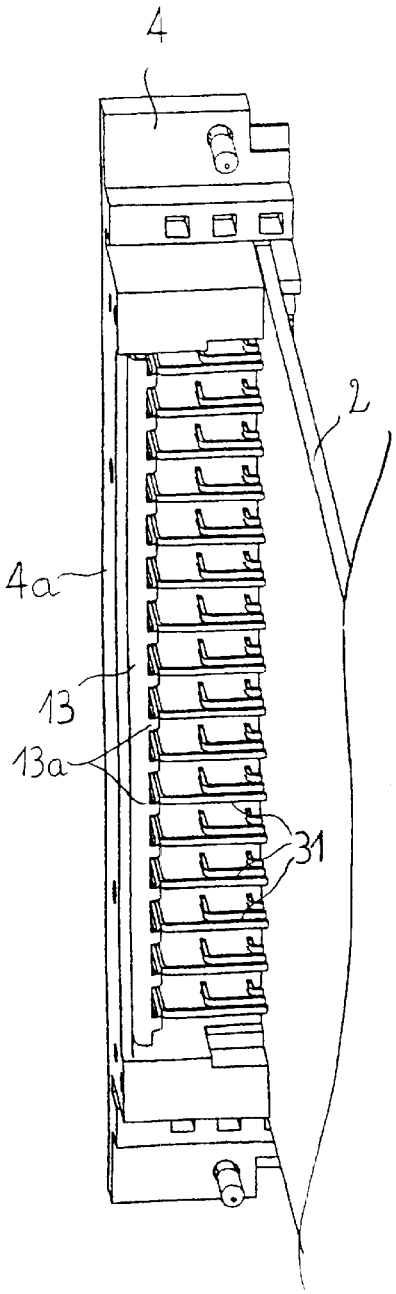
FIG. 11 is a rear perspective view of a variant embodiment of the protection device of FIG. 8.
Figure 12:
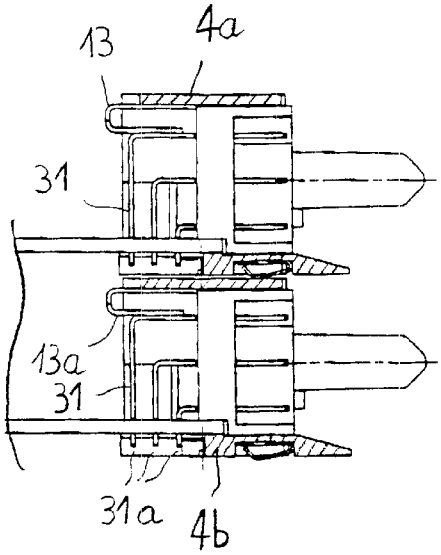
FIG. 12 is a view similar to FIG. 10 of the variant embodiment of FIG. 11.

FIGS. 11 to 12 show a variant of the second embodiment of the protection device described with reference to FIGS. 7 to 10, in which the first shielding element and the grounding conductor track of the printed circuit are implemented differently, the other elements remaining identical to those described with reference to FIGS. 7 to 10. As shown in FIG. 11, the body of the fascia element 4 (identical to the element described in the second embodiment) includes a top wall 4*a* co-operating with an uninterrupted metal sheet 13 mounted against the top wall 4*a* to constitute a first shielding element. The metal sheet 13 extends parallel to the printed circuit board over the rear portion of the fascia element 4, and it is provided with a curved-over end having tabs 13*a* that come into abutment against the top row of pins 31 of the connector 3, i.e. the row furthest from the printed circuit board 2. The top row of pins 31 extends parallel to the board from the front face of the connector 3 to the vicinity of the rear face of the connector 3, and then extends perpendicularly to the printed circuit board 2 at the rear face of the connector 3, so that the ends of the pins 31 that form spikes 31*a* penetrate into plated through holes in the printed circuit board 2 and are in contact with a grounding conductor track of the printed circuit.

The metal sheet 13 is held in contact with the bottom face of the top wall 4*a* by two screws so that electrical continuity exists between the metal sheet 13 and the fascia element 4 which is made of an electrically-conductive material.

The second shielding element 4*b* of this variant embodiment is entirely identical to that described with reference to FIGS. 7 to 10, and it is in contact with a conductor track of the printed circuit board 2 that is connected to the grounding conductor track of the circuit, to which grounding track the end spikes 31*a* of the top row of pins 31 are connected.

Such a variant embodiment makes it possible, similarly to the variant embodiment of FIGS. 5 and 6, to use the top row of pins in association with the metal sheet supported by the top portion of the fascia element to implement the first shielding element of the connector.

What is claimed is:

1. An electrical connector mounted on a printed circuit board and having a protection device for protecting the electrical connector from electromagnetic interference, said connector including a body made of a plastics material having a front face serving to co-operate with a removable plug and a connection side face touching the printed circuit board, said connector including a plurality of contacts, each of which has one end in the form of a spike that projects from the connection side face, said spikes being inserted through holes in said printed circuit board for a purpose of electrically connecting the contacts to one or more conductor tracks of said printed circuit, said protection device comprising a first shielding element extending along the side face of the connector that is opposite from the connection side face, and continuing along a rear face of the connector so as to come into contact with a grounding conductor track of the printed circuit board, and a second shielding element mounted on a face of the printed circuit board which is opposite from a face of the printed circuit board in contact with the connector, and extending along said connection side face, said second shielding element being in contact with a conductor track connected to said grounding track of the printed circuit board so as to be electrically connected to the first shielding element and so as to form a potential cage, wherein said second shielding element is constituted by a metal sheet which is in contact with a track disposed at a surface of the printed circuit board and connected to the grounding track to which the spikes of the first shielding element are connected; and wherein said printed circuit board is designed to equip a rack module provided with many electronics cards disposed side-by-side, and wherein the metal sheet is provided with resilient tongues projecting sideways from a fascia element so as to establish electrical contact with the shielding elements of a second connector carried by an adjoining electronics card that is held in said rack module.

2. An electrical connector mounted on a printed circuit board and having a protection device for protecting the electrical connector from electromagnetic interference, said connector including a body made of a plastics material and having a front face serving to co-operate with a removable plug and a connection side face touching the printed circuit board, said connector including a plurality of contacts, each of which has one end in a form of a spike that projects from the connection side face, said spikes being inserted through holes in said printed circuit board for a purpose of electrically connecting the contacts to one or more conductor tracks of said printed circuit, said protection device comprising a first shielding element extending along the side face of the connector that is opposite from the connection side face, and continuing along a rear face of the connector so as to come into contact with a grounding conductor track of the printed circuit board, and a second shielding element mounted on a face of the printed circuit board which is opposite from a face of the printed circuit board in contact with the connector, and extending along said connection side face, said second shielding element being in contact with a conductor track connected to said grounding track of the printed circuit board so as to be electrically connected to the first shielding element and so as to form a potential cage, wherein said second shielding element is constituted by a metal sheet which is in contact with a track disposed at a surface of the printed circuit board and a connected to the grounding track to which the spikes of the first shielding element are connected;

wherein said printed circuit board is designed to equip a rack module provided with many electronics cards disposed side-by-side, and wherein the metal sheet is provided with resilient tongues projecting sideways from a fascia element so as to establish electrical contact with the shielding elements of a second connector carried by an adjoining electronics card that is held in said rack module; and wherein said fascia element includes an electrically-conductive body surrounding all four side faces of the connector, said fascia element including a top wall adjacent to that side wall of the connector which is opposite from the connection side face, and a bottom wall adjacent to the printed circuit board, the walls respectively participating in forming the first and second shielding elements.

3. The electrical connector mounted on a printed circuit board and having a protection device for protecting the electrical connector from electromagnetic interference according to claim 2 for protecting an electrical connector, wherein said fascia element includes an electrically-conductive body surrounding all four side faces of the connector, said fascia element including a top wall adjacent to a side wall of the connector which is opposite from the connection side face, and a bottom wall adjacent to the printed circuit board, the walls respectively participating in forming the first and second shielding elements, and wherein said first shielding element is formed by the top wall and by a metal angle bracket mounted against the top wall, said angle bracket having a branch extending along the rear face of the connector and being fixed to the top wall so that electrical continuity exists between the angle bracket and the top wall.

4. An electrical connector mounted on a printed circuit board and having a protection device for protecting the electrical connector from electromagnetic interference, said connector including a body made of a plastics material and having a front face serving to co-operate with a removable plug and a connection side face touching the printed circuit board, said connector including a plurality of contacts which form rows of contacts including a top row of contacts, each contact having one end in a form of a spike that projects from the connection side face, said spikes being inserted through holes in said printed circuit board for a purpose of electrically connecting the contacts to one or more conductor tracks of said printed circuit, said protection device comprising a first shielding element extending along the side face of the connector that is opposite from the connection side face, and continuing along a rear face of the connector so as to come into contact with a grounding conductor track of the printed circuit board, and a second shielding element mounted on a face of the printed circuit board which is opposite from a face of the printed circuit board in contact with the connector, and extending along said connection side face, said second shielding element being in contact with a conductor track connected to said grounding track of the printed circuit board so as to be electrically connected to the first shielding element and so as to form a potential cage;

wherein said first shielding element comprises a metal element that is substantially uninterrupted and that extends along the rear face of the connector to a vicinity of the printed circuit board of the printed circuit, an edge of the metal element which is adjacent to the printed circuit board being provided with spikes that are inserted into plated through holes in the printed circuit board, which holes are in contact with the grounding track of the printed circuit board;

wherein a fascia element includes an electrically-conductive body surrounding all four side faces of the connector, said fascia element including a top wall adjacent to a side wall of the connector which is opposite from the connection side face, and a bottom wall adjacent to the printed circuit board, the walls respectively participating in forming the first and second shielding elements, and wherein said first shielding element is formed by the top wall and by a metal angle bracket mounted against the top wall, said angle bracket having a branch extending along the rear face of the connector and being fixed to the top wall so that electrical continuity exists between the angle bracket and the top wall;

wherein said first shielding element is formed by the top wall and by a metal sheet mounted against the top wall and co-operating with the top row of contacts, said metal sheet having a curved-over end coming into contact with said top row of contacts, and wherein said second shielding element is formed by the bottom wall which is in contact with a conductor track disposed at the surface of the printed circuit board and connected to the ground track to which the spikes of the first shielding element are connected; and wherein said printed circuit board is designed to equip a rack module provided with many electronics cards disposed side-by-side, and wherein the bottom wall is provided with resilient tongues that project sideways from the fascia element so as to establish electrical contact with the shielding elements of a connector carried by an adjoining electronics card that is held in said rack module.

5. An electrical connector mounted on a printed circuit board and having a protection device for protecting the electrical connector from electromagnetic interference, said connector including a body made of a plastics material and having a front face serving to co-operate with a removable plug and a connection side face touching the printed circuit board, said connector including a plurality of contacts, each of which has one end in a form of a spike that projects from the connection side face, said spikes being inserted through holes in said printed circuit board for a purpose of electrically connecting the contacts to one or more conductor tracks of said printed circuit, said protection device comprising a first shielding element extending along the side face of the connector that is opposite from the connection side face, and continuing along a rear face of the connector so as to come into contact with a grounding conductor track of the printed circuit board, and a second shielding element mounted on a face of the printed circuit board which is opposite from a face of the printed circuit board in contact with the connector, and extending along said connection side face, said second shielding element being in contact with a conductor track connected to said grounding track of the printed circuit board so as to be electrically connected to the first shielding element and so as to form a potential cage, wherein said second shielding element is constituted by a metal sheet which is in contact with a track disposed at a surface of the printed circuit board and connected to the grounding track to which the spikes of the first shielding element are connected;

wherein said printed circuit board is designed to equip a rack module provided with many electronics cards disposed side-by-side, and wherein the metal sheet is provided with resilient tongues projecting sideways from a fascia element so as to establish electrical contact with the shielding elements of a second connector carried by an adjoining electronics card that is held in said rack module;

wherein said fascia element includes an electrically-conductive body surrounding all four side faces of the connector, said fascia element including a top wall adjacent to that side wall of the connector which is opposite from the connection side face, and a bottom wall adjacent to the printed circuit board, the walls respectively participating in forming the first and second shielding elements; and wherein said connector complies with DIN Standard type E48.

* * * * *